US005277124A

United States Patent [19]

DiFonso et al.

[11] Patent Number: 5,277,124

[45] Date of Patent: Jan. 11, 1994

[54] DIRECTION CONTROL ASSEMBLY FOR A MATERIAL HANDLING CAR HAVING PIVOTED DIVERT AIMS ENGAGING TRACKS FOR GUIDANCE IN SWITCH AREA

[75] Inventors: Gene DiFonso, Arlington; Joel L. Staehs, DeSoto; Charles A. Kemp, Richardson, all of Tex.; William C. Bortzfield, deceased, late of Grand Prarie, Tex., by Beverly J. Bortzfield, executor

[73] Assignee: BAE Automated Systems, Inc., Carrollton, Tex.

[21] Appl. No.: 967,712

[22] Filed: Oct. 28, 1992

[51] Int. Cl.[5] ..... E01B 7/00; E01B 26/00

[52] U.S. Cl. ..... 104/130; 246/433

[58] Field of Search ..... 104/130; 246/415

[56] References Cited

U.S. PATENT DOCUMENTS

| | | | |
|---|---|---|---|
| 3,626,857 | 12/1971 | Omar | 104/119 |
| 3,628,462 | 12/1971 | Holt | 104/105 |
| 3,812,789 | 5/1974 | Nelson | 104/130 |
| 3,835,785 | 9/1974 | Kirchner et al. | 104/130 |
| 3,841,225 | 10/1974 | Johnson | 104/130 |
| 3,847,086 | 11/1974 | Steenbeck | 104/130 |
| 4,213,396 | 7/1980 | Mehren et al. | 104/130 |
| 4,215,837 | 8/1980 | Uozumi et al. | 246/433 |
| 4,290,367 | 9/1981 | Brause et al. | 104/130 X |
| 4,484,526 | 11/1984 | Uozumi | 104/131 |
| 4,671,185 | 6/1987 | Anderson et al. | 104/130 |
| 5,063,857 | 11/1991 | Kissel, Jr. | 104/130 X |

*Primary Examiner*—Robert J. Oberleitner
*Assistant Examiner*—S. Joseph Morano
*Attorney, Agent, or Firm*—Lorusso & Loud

[57] ABSTRACT

Direction control assembly for a material handling car having travel wheels mounted thereon and adapted to operate on parallel rails, the control assembly comprising a ramp assembly adapted to receive and respond to a signal from a computer to direct a next approaching car onto one of a main track and a side track, a sensor upstream of the ramp assembly operative to detect the approach of the car and initiate the signal from the computer to the ramp assembly, a first guide wheel mounted on a first arm extending outwardly from the car on a first side of the car, a second guide wheel mounted on a second arm extending outwardly from the car on a second side of the car, each of the guide wheels being connected to a divert arm pivotally mounted on the car and having mounted thereon a divert wheel, the ramp assembly being adapted in response to the signal to assume a position in which part of the ramp assembly is engageable by one of the guide wheels, causing one of the divert arms to pivot and one of the divert wheels to engage a selected one of the first and second rails, whereby to lock the car to the selected rail, such that the car follows the selected rail into the selected one of the main track and the side track.

13 Claims, 8 Drawing Sheets

DIRECTION CONTROL ASSEMBLY FOR A MATERIAL HANDLING CAR HAVING PIVOTED DIVERT AIMS ENGAGING TRACKS FOR GUIDANCE IN SWITCH AREA

BACKGROUND OF THE INVENTION

1. Field of the Invention

This invention relates to a material handling car and track assembly and is directed more particularly to direction control means for directing the car along a selected one of a plurality of track avenues.

2. Description of Prior Art

A number of mechanisms have been devised for switching of track supported cars between alternative paths. In U.S. Pat. No. 3,626,857, issued Dec. 14, 1971 to A. G. Omar, there is disclosed a pivotally moveable track section which may be moved to place tracks thereon in alignment with a selected distal track section. Omar also discloses another mechanism wherein one of a plurality of selected switch tracks is raised into a gap between a base track and a selected distal track. The plurality of switch tracks is interconnected such that when a selected switch track is raised to fill the aforesaid gap, the remainder of the switch tracks are necessarily held below the level of the gap, so that only one switch track at a time can occupy the gap.

In the U.S Pat. No. 3,847 086, issued Nov. 12, 1974 to Ulf Steenbeck, there is disclosed a suspended railway system in which switch tracks are immoveably disposed with each switch track section having thereon a plurality of paths. Each of the paths is provided with electromagnetic means which guide a car onto a selected path in the switch track section, and thereby onto a selected distal track section.

A U.S. Pat. No. 4,484,526, issued Nov. 27, 1984 to Yukio Uozumi, there is disclosed a switching system in which the car supporting tracks remain immoveable, and a guide rail adapted for guiding guide wheels of the car includes moveable guide rail switch sections which are vertically moveable into and out of active position in the guide rail.

U.S. Pat. No. 3,628,462, issued Dec. 21, 1971, to William J. Holt discloses a track system for suspended vehicles. The system utilizes horizontal guide rollers on a car which engage a vertical surface of a channel structure. Each car is provided with guide rollers on each side of the car. The car is provided with a solenoid which operates armature elements to raise the guide rollers of one side or the other. The guide rollers are disposed on both ends of a single crankarm which is acted upon by the armature elements. The crankarm is pivotally mounted such that when the guide roller on one side is raised to actively engage the channel structure, the other guide roller on the other side is necessarily removed from engagement with the channel structure.

SUMMARY OF THE INVENTION

An objective of the present invention is to provide a direction control assembly for a material handling car which is supported by, and moveable upon, a track comprising a pair of rails.

A further object is to provide such a system in which the car is provided with a divert wheel on each side thereof, each divert wheel being adapted to engage a track rail portion at an appropriate time to cause the car to follow the direction of the engaged track rail.

A still further object is to provide such a system in which the car is provided with a guide wheel mounted on each side of the car, and ramp means positioned on each side of the track, the ramp means being operable to maneuver, in response to a signal, to be engaged by one of the guide wheels which, in turn, causes the appropriate divert wheel to engage the selected track rail portion.

A still further object is to provide such a system in which the guidance mechanism on the car is inert and adapted to respond to active mechanisms of the track assembly.

A still further object is to provide such a system in which the ramp means are interconnected such that only one of a pair of ramps may be moved to an activating position for a given car.

A still further object is to provide in such a system having means responsive to loss of electrical power for activating the ramps so as to divert cars onto side tracks.

With the above and other objects in view, as will hereinafter appear, a feature of the present invention is the provision of a direction control assembly for a material handling car having travel wheels mounted thereon and adapted to operate on parallel rails, the rails each comprising a horizontal plate portion on which the travel wheels are adapted to roll, and an outboard vertical plate portion adapted to contain the wheels on the rail horizontal plate portion, the control assembly comprising a ramp assembly including a first ramp disposed adjacent and outboard of a first of the rails and a second ramp disposed adjacent and outboard of a second of the rails and generally abreast of the first ramp, the ramps being disposed adjacent the path of travel of the car upstream of a bifurcation of the rails into a main track and a side track, the ramp assembly being adapted to receive and respond to a signal from a computer to direct a next approaching car onto one of the main track and the side track, detection means upstream of the ramp assembly operative to detect the approach of the car and initiate a signal from the computer to the ramp assembly, a first guide wheel mounted on a first arm extending outwardly from the car on a first side of the car, a second guide wheel mounted on a second arm extending outwardly from the car on a second side of the car, each of the guide wheels being connected to a divert arm pivotally mounted on the car and having mounted thereon a rotatable divert wheel, the ramps being adapted, in response to the signal, to move to a position in which one of the ramps is engageable by one of the guide wheels, causing one of the divert arms to pivot and one of the divert wheels to engage an outboard surface of the vertical plate portion of a selected one of the first and second rails, whereby to connect the car to the selected rail, such that the car follows the selected rail onto the selected one of the main track and the side track.

In accordance with a further feature of the invention, there is provided in the ramp assembly of the above described control assembly an interlock mechanism interconnecting the first ramp and the second ramp and adapted to permit only one of the first and second ramps to be moved to an activating position for a given car.

In accordance with a still further feature of the invention, there is provided in the above described direction control assembly, means responsive to loss of electrical power for activating the ramps so as to divert cars onto the side track.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 2:
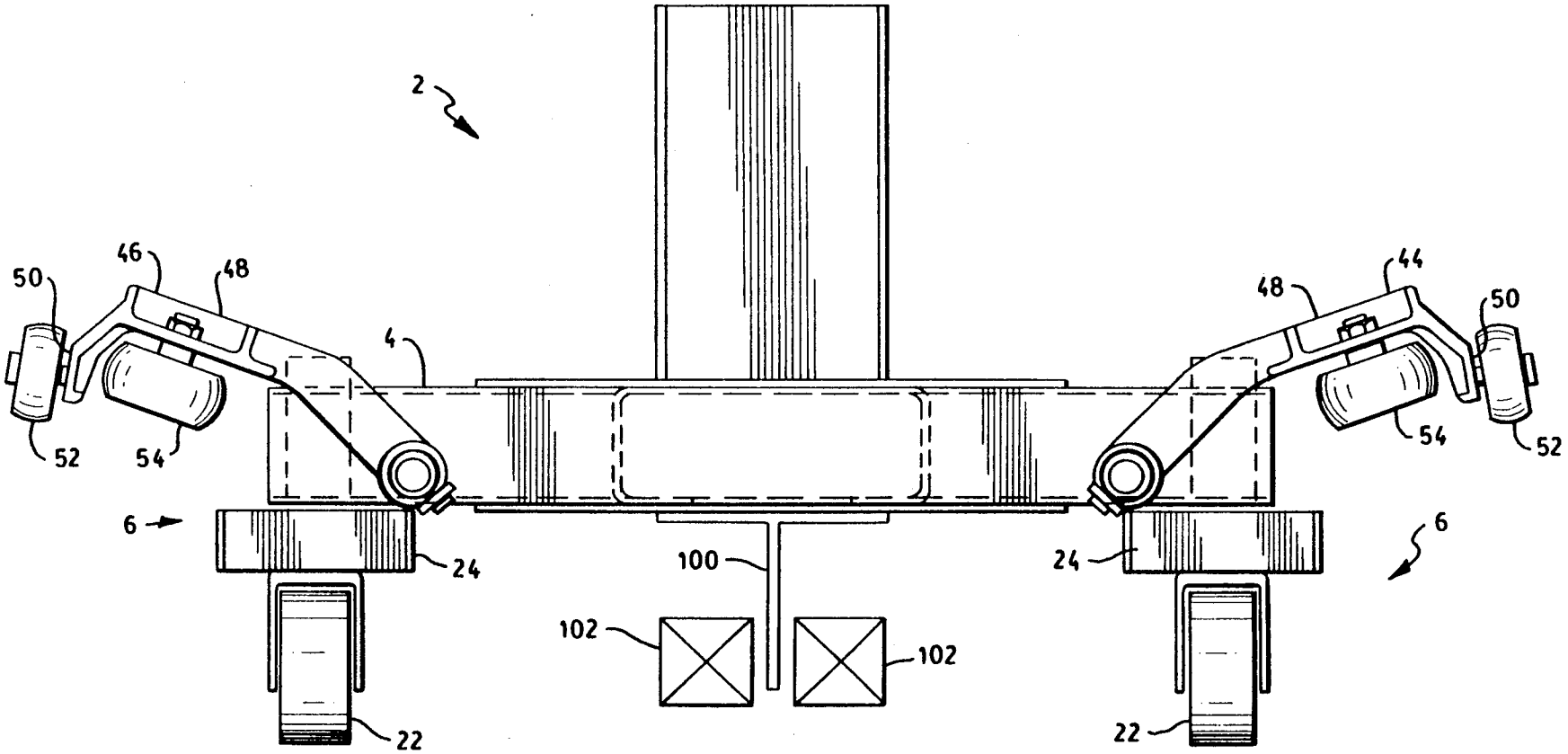
FIG. 2 is a front elevational view of a material handling car chassis.

The material handling car 1 on which the present direction control assembly finds utility includes a chassis portion 2 having a frame 4 (FIG. 2) on which are mounted four travel wheel assemblies 6. The chassis has mounted thereon a tray 8 (FIG. 4) adapted for pivotal movement to accept, carry, and discharge given material such as, for example, a piece of luggage.

Figure 3:
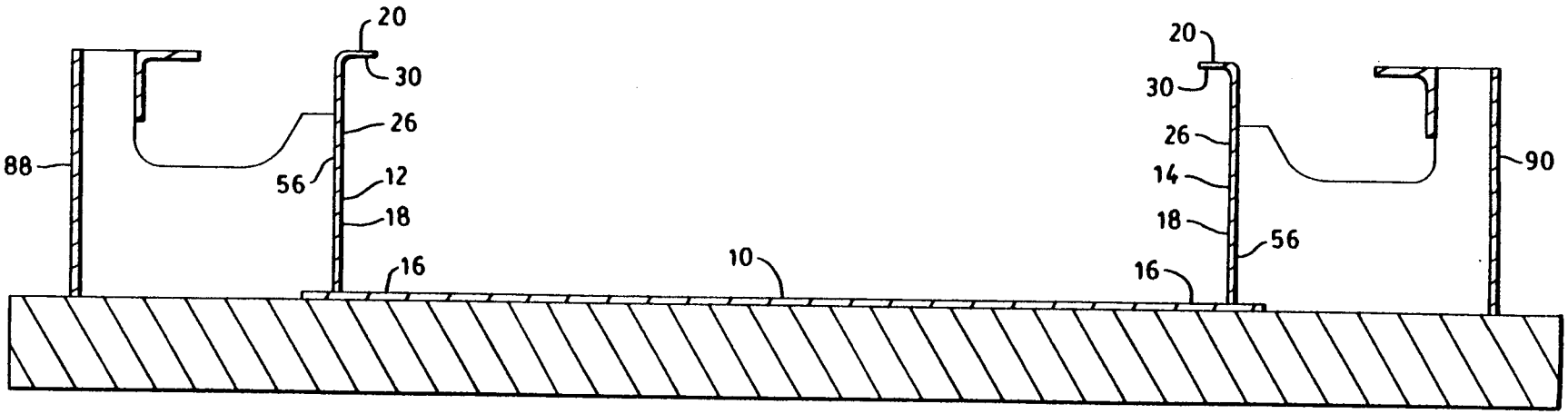
FIG. 3 is a front elevational view of a divert module.
Figure 4:
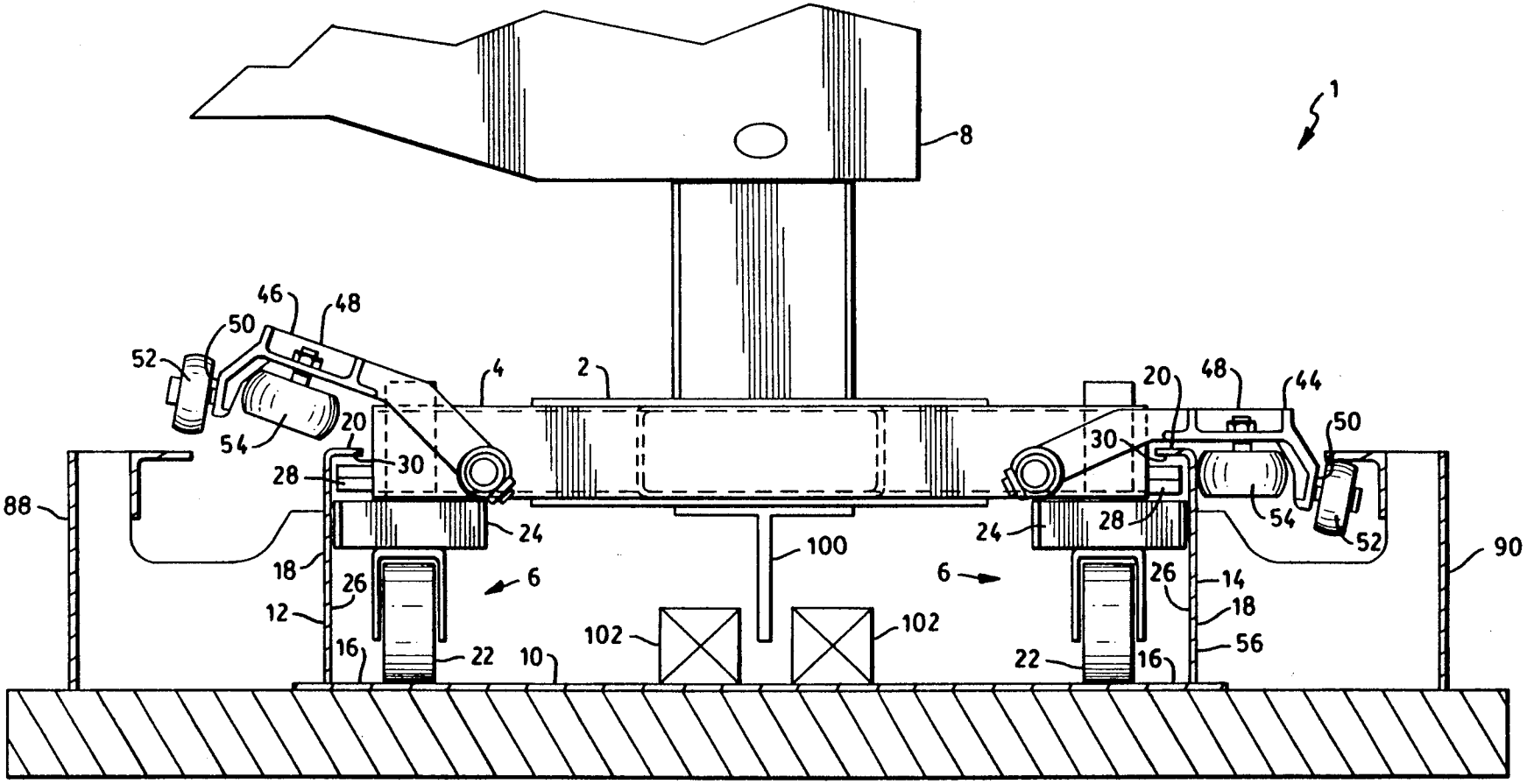
FIG. 4 is a front elevational view of a material handling car including the chassis of FIG. 2 on a section of track and with divert arm assemblies mounted thereon, and showing therewith the divert module of FIG. 3.

The travel wheel assemblies 6 are adapted to cooperate with a track assembly 10 including a pair of parallel opposed u-shaped rails 12, 14 (FIGS. 3 and 4). Each of the rails 12, 14 includes a bottom plate 16, a vertical plate portion 18 upstanding from the bottom plate 16, and a top plate 20 extending inboard from an upper edge of the vertical plate 18. Each travel wheel assembly includes a vertical travel wheel 22 supported by, and adapted to roll on, the track bottom plate 16, and a horizontal wheel 24 adapted to engage an inboard surface 26 of the vertical plate 18. The travel wheel assembly may also include a wear block 28 (FIG. 4) adapted to engage an undersurface 30 of the top plate 20 in the event the car experiences an external force, such as in a collision, which would tip the car up on two wheels. In such event, the wear block 28 is adapted to slide along the undersurface 30 of the top plate 20. Thus, each travel wheel assembly is captured by a generally u-shaped rail.

Figure 1:
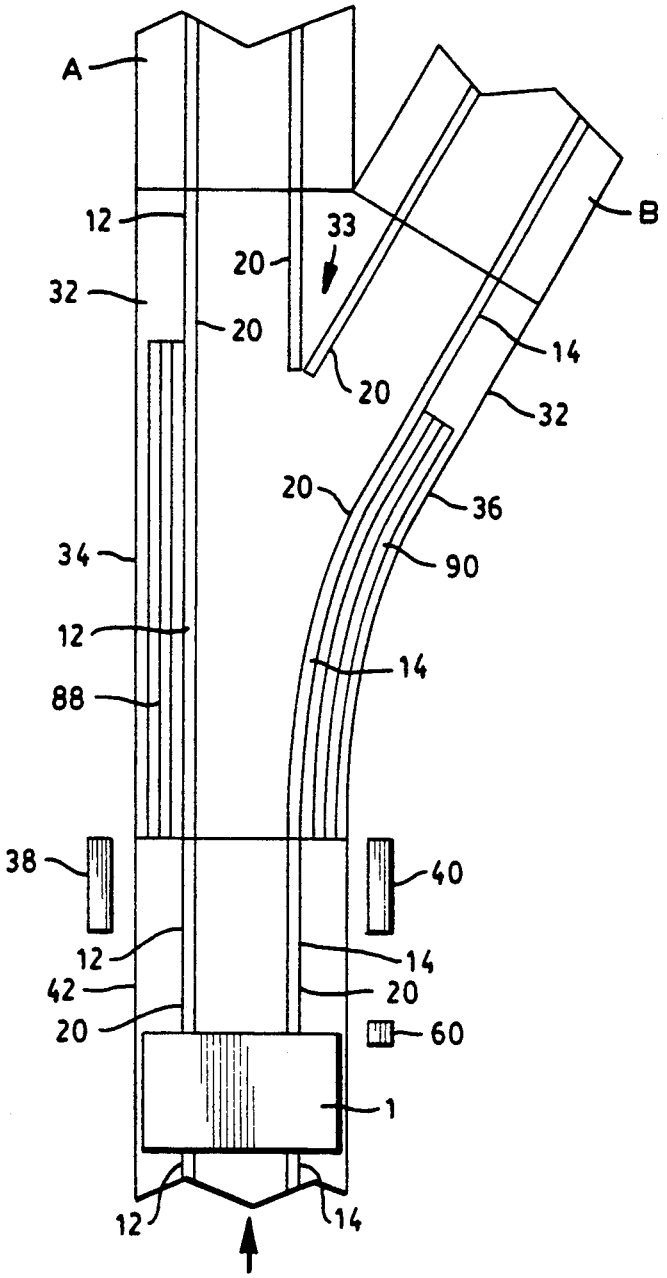
FIG. 1 is a diagrammatic plan view of a divert track section, including a track bifurcation, illustrative of an embodiment of the invention.

The track system on which the car 1 is adapted to move includes a main track A (FIG. 1) adapted to facilitate travel of the car 1 from one station to another, and a number of side tracks and cross-over tracks B adapted to present the car appropriately at loading, unloading, and rest stations; and to cross-over from one main track section to another.

The track system further is provided with divert sections 32 (FIG. 1) which include a main track portion 34 and a side track portion 36. The divert sections 32 are each provided with a ramp assembly 35 having a pair of ramps 38, 40, the ramp assembly being disposed adjacent and on both sides of an approach track section 42. The main and side track portions 34, 36, lead, respectively, to the main and side track sections A, B.

Each car is provided with arm means comprising a pair of divert arm assemblies 44, 46 (FIG. 4) adapted to react to engagement with the ramps 38, 40 to determine the direction of travel of the car at a bifurcation 33. Each divert arm assembly includes a first portion adapted for engagement with the ramp means and a second portion adapted to engage the vertical wall portion of a rail.

Each of the divert arm assemblies 44, 46 comprises a pivotally mounted divert arm 48 (FIGS. 2 and 4) having removeably mounted on a distal end 50 thereof a guide wheel 52, which extends further outboard of the car than does the free end of the arm 48. The guide wheel 52, which comprises the above-mentioned first portion of the divert arm assembly, is a generally vertical wheel and removeably mounted inboard thereof and proximate the guide wheel on the divert arm is a rail engagement means, preferably in the form of a generally horizontal divert wheel 54. The divert wheel comprises the above-mentioned second portion of the divert arm assembly. The guide wheel 52 of both divert arm assemblies 44. 46 is adapted to engage one of the ramps 38, 40 on its respective side of the track when its respective ramp is raised into an active position. The first divert arm 48 extends from a first side of the car and is adapted to engage the first ramp when the first ramp is raised, and the second divert arm extends from a second side of the car and is adapted to engage the second ramp when the second ramp is raised. Upon engagement with the appropriate ramp, the guide wheel 52 is caused by the ramp to descend from the raised position shown at the left in FIG. 4 to the lower position shown at the right in FIG. 4, with the divert wheel 54 engaging an outboard surface 56 of the vertical plate portion 18 of the appropriate track rail, 14 in FIG. 4, to lock the car onto the rail.

The car thus is moveably secured to the selected rail, 14 in FIG. 4, by the cooperation of the horizontal wheel 24 and the divert wheel 54 and follows along the rail 14, diverting at the bifurcation 33 from the rail 12 to move onto the side track section B. It will be apparent that by activation of the other of the two ramps 38, the other divert arm assembly 44 similarly engages the rail 12 to cause the car to follow along the rail 12, remaining at the bifurcation 33 on the main track portion 34, leading to the main track section A, passing by the side track section B.

Figure 8:
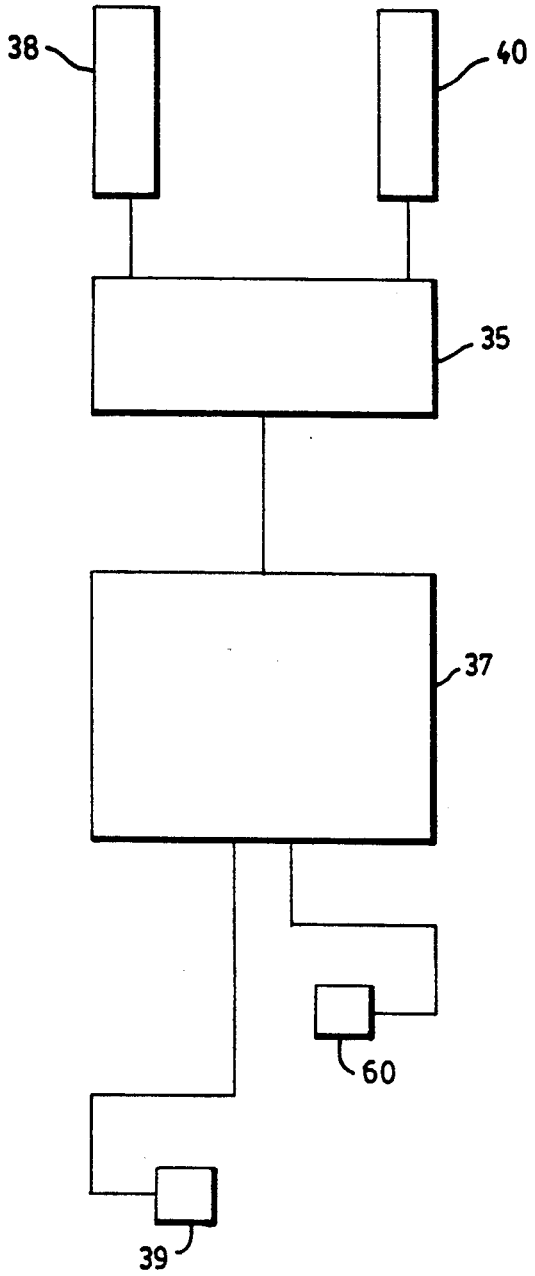
FIG. 8 is a diagrammatic representation of the ramp assembly-operating car approach detection and computer signal system.

Each ramp assembly 35 is provided with means for receiving instructions, as from a central computer 37 (FIG. 8), to direct a next approaching car onto one of the main track portion 34 and side track portion 36. First detection means, such as photo-electric cells 39 (FIG. 8) are disposed about twenty-five feet upstream of the ramp assembly 35 and operate to detect the approach of a car, and signal the computer 37 that a car is in position, to be identified. Near the upstream photocell 39 is an antenna (not shown) adapted to receive a signal from a transponder (not shown) mounted on the car. The signal from the car transponder to the antenna identifies the car. The signal to the antenna is forwarded to the computer 37 which interrogates its data bank to ascertain the car's destination. The computer stores the command it will send to the ramp assembly 35. As the car further nears the ramp assembly, the car passes another photo-cell 60 (FIG. 1) which instructs the computer to release the stored command to the ramp assembly 35. If the ramp assembly is already properly positioned, it remains so. If the ramp assembly is in the opposite position, it will be activated by the computer command to switch positions.

Figure 5:
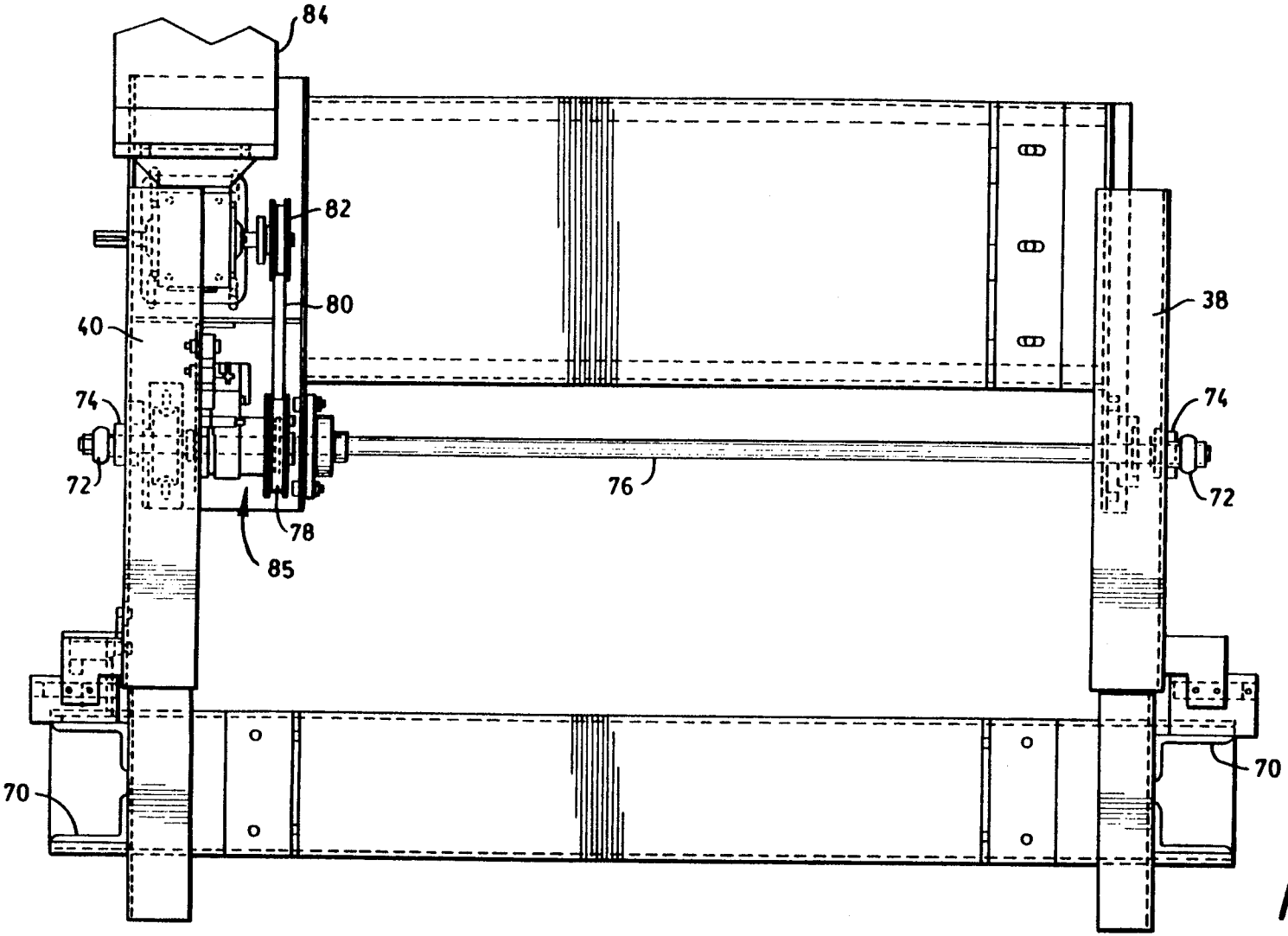
FIG. 5 is a top plan view of the ramp assembly portion of the illustrative invention.
Figure 6:
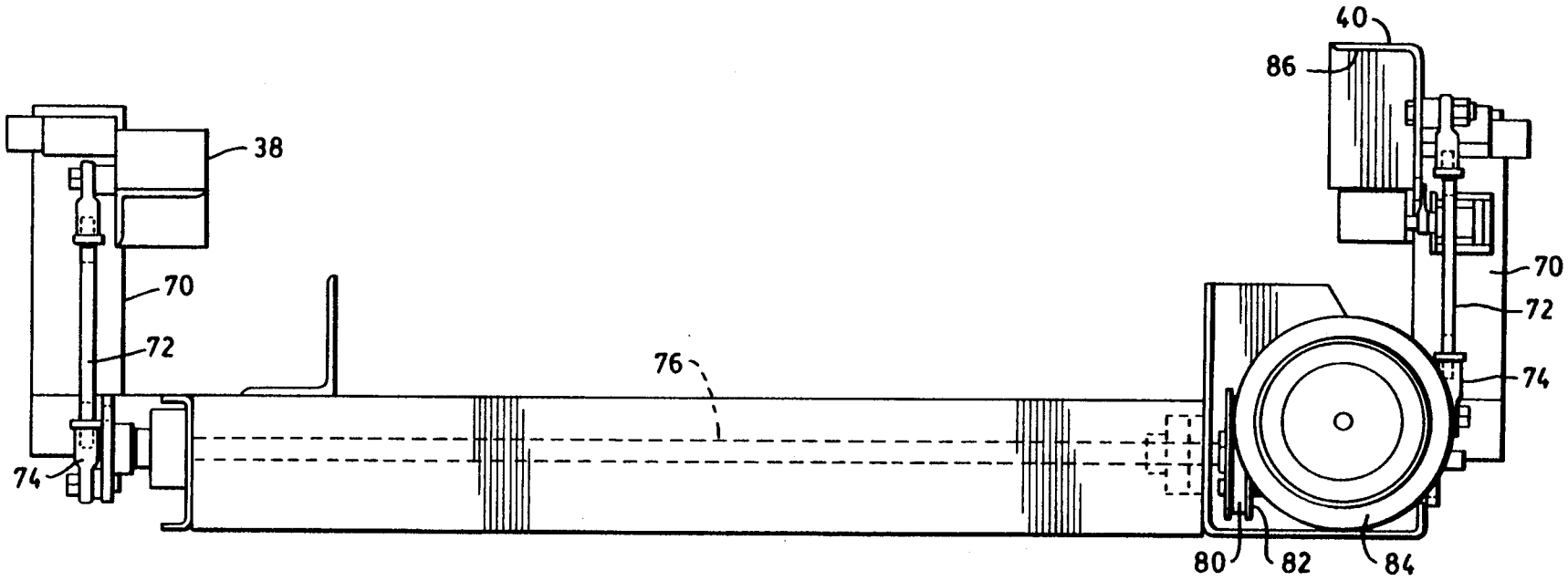
FIG. 6 is a end view of the ramp assembly portion.
Figure 7:
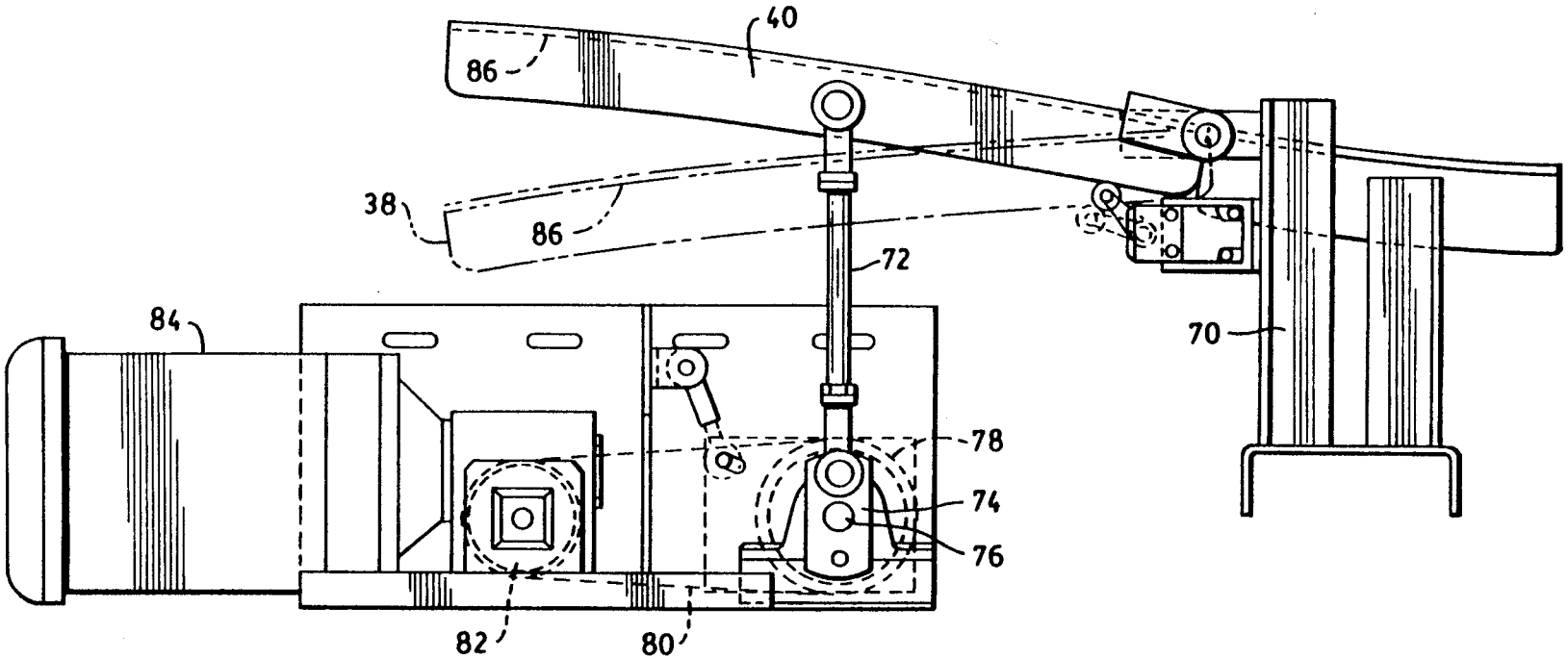
FIG. 7 is a side view of the ramp assembly portion.

Referring to FIGS. 5–7, it will be seen that the ramp assembly 35 comprises the ramps 38, 40 each pivotally mounted on an upstanding track frame member 70. The first of the ramps 38 is disposed adjacent and outboard of the first of the rails and the second of the ramps 40 is disposed adjacent and outboard of the second of the rails. Each of the ramps 38, 40 has pivotally attached thereto a first end of a drive rod 72 (FIG. 7) which is pivotally and eccentrically attached at its second end to a rotatable plate 74. The two rotatable plates 74 are interconnected by an axle 76 which is attached to a wheel 78 driven by a belt or chain 80 wound about a drive wheel 82 driven by a motor 84. The drive rods 72 are connected to opposite ends of the respective rotatable plates 74, such that when one drive rod is at its uppermost position, the other is at its lowermost position, as may be seen in FIGS. 6 and 7.

In operation, the material handling car 1 moves along the main track with, for example, luggage delivered thereto from an aircraft. As the car approaches a discharge station inappropriate for the luggage carried, the central computer 37 will identify the car as one that should stay on the main track. The appropriate command signal is stored in the computer. As the car approaches and intercepts a beam projected by the photoelectric cell 60, the cell 60 instructs the computer 37 to send the ramp activating signal and the computer signal is sent to the ramp assembly 35 to operate in accordance with the computer's instructions, that is, to keep the car on the main track.

The motor 84 runs continuously when the system is in operation. The ramp positioning signal from the computer energizes a wrap spring clutch 85 (FIG. 5) which is mounted on the axle 76 and which is driven by the motor 84. The clutch 85 drives the axle 76 to position the rotatable plates 74, such that the ramp 38 is raised and the ramp 40 is lowered. The raised ramp 38 is engaged by the guide wheel 52 on an undersurface 86 of the ramp. The guide wheel 52 is guided by the ramp into a divert module 88 (FIGS. 1, 3 and 4), which holds the guide wheel 52 in a lowered position and thereby locks the divert wheel 54 in a rail engaging position throughout the track divert section 32. Inasmuch as the horizontal wheel 24 and the divert wheel 54 of the divert arm assembly 44 are locked onto the rail 12, the car moves through the divert section 32 onto the main track portion 34 and continues along the main track section A, past the side track section B.

As the car approaches the next discharge station, the central computer 37 may determine that the ramp assembly 35 associated with that station should be activated to divert the car to the discharge station. The proper signal is stored in the computer. As the car approaches and intercepts the beam projected by the photoelectric cell 60, the signal is sent to the ramp assembly 35 to operate in accordance with the computer's instructions, that is, to divert the car onto the side track leading to the discharge station.

The motor 84, through the clutch 85, drives the axle 76 to position the rotatable plates 74 such that the ramp 40 is raised and the ramp 38 is lowered (FIGS. 6 and 7). The raised ramp 40 is engaged by the guide wheel 52 on the undersurface 86 of the ramp. The guide wheel 52 is guided by the ramp downwardly into a divert module 90 (FIG. 4), which is attached to the track and has therein channel means adapted to receive the guide wheel 52, and retain the guide wheel in a lowered position to hold the divert wheel 54 in a rail engaging position throughout the track divert section 32, until the car is securely on the selected one of the main track and side track. Inasmuch as the horizontal wheel 24 and the divert wheel 54 of the divert arm assembly 48 are locked onto the rail 14, the car moves through the track divert section 32 on the side track portion 36, onto the side track section B, and toward the appropriate discharge, or unloading, station.

In the material handling car system envisaged herein, the cars have no power means therein. The chassis portion 2 of the car is provided with a depending vane 100 (FIGS. 2 and 4), which passes between opposed linear motors 102 which act upon the vane 100 to urge the vane, and thereby the car, forwardly. Such linear motors are positioned at intervals along the main track to keep the cars moving therealong.

At load, unload, and rest stations, it is necessary to have stronger thrust means, as well as strong braking means, to bring the cars to a reduced speed or stop for loading, unloading, or storing, and strong thrusting means for getting cars at a stop or at slow speeds up to traveling speed, which may be on the order of 15–20 m.p.h. While the linear motors spaced along the main track are adequate to maintain moving cars at a desired travel speed, they lack the thrust capability to quickly bring stopped or very slowly moving cars up to desired travel speed.

Accordingly, upon loss of power in the system, the central computer signals all the ramp assemblies in the system to operate so as to divert all cars onto the associated side track. When power is restored, relatively strong thrust means (not shown) located along the side tracks are able to rapidly start the cars moving, returning them to the main track at, or near, main track travel speed, which is then maintained by the linear motors.

It is to be understood that the present invention is by no means limited to the particular construction herein disclosed and/or shown in the drawings, but also comprises any modifications or equivalents within the scope of the claims.

Having thus described our invention, what we claim as new and desire to secure by Letters Patent of the United States is:

1. Direction control assembly for a material handling car having travel wheels mounted thereon and adapted to operate on a track having parallel opposed u-shaped rails, the control assembly comprising a ramp assembly including ramp means disposed adjacent and outboard of said track, said ramp assembly being disposed upstream of a bifurcation of said track into first and second tracks, said ramp assembly being adapted to receive and respond to a signal to direct a next approaching car onto one of said first and second tracks, arm means including a first divert arm pivotally mounted on said car, a first guide wheel mounted on said first divert arm for engagement with said ramp means, a first divert wheel mounted on said first divert arm for engagement with one of said rails, detection means upstream of said ramp assembly to detect the approach of said car and to instruct a computer to identify said car and to instruct said computer to signal said ramp assembly to move at least a portion of said ramp means to a position at which said ramp means will be engaged by said first guide wheel, said first divert wheel being operable by said first divert arm, upon engagement of said first guide wheel with said ramp means, to engage said one of said rails and thereby attach said car to said one rail, and divert modules attached to said track and having therein channel means adapted to receive said first guide wheel from said ramp means and retain said first guide wheel in position to retain said first divert wheel in said rail-engaging position until said car moves onto said one of said first and second tracks.

2. The control assembly in accordance with claim 1 wherein said ramp means comprises a first ramp disposed adjacent and outboard of a first of said rails and a second ramp disposed adjacent and outboard of a second of said rails, and wherein upon receipt of said signal from said computer, said ramp assembly operates in accordance with said signals to position one of said first and second ramps to be engaged by said arm means.

3. The control assembly in accordance with claim 2 wherein said arms means comprises said first divert arm extending from a first side of said car and having said first guide wheel engageable with said first ramp when said first ramp is engageably positioned, and a second divert arm extending from a second side of said car and having a second guide wheel engageable with said second ramp when said second ramp is engageably positioned.

4. The control assembly in accordance with claim 3 wherein said first divert wheel is disposed on said first side of said car and adapted to engage said first of said rails when said first divert arm means engages said first ramp, and a second divert wheel is disposed on said second side of said car and adapted to engage said second of said rails when said second divert arm means engages said second ramp.

5. The control assembly in accordance with claim 4 wherein said first divert wheel is fixed to said first divert arm and said second divert wheel is fixed to said second divert arm.

6. The control assembly in accordance with claim 5 wherein said travel wheels include two wheel assemblies on each of said sides of said car, each wheel assembly including a first generally vertical travel wheel engaged with a bottom plate portion of said rails, and a second generally horizontal travel wheel adapted to engage a generally vertical wall portion of said rails.

7. The control assembly in accordance with claim 6 wherein on said first and second divert arms said first and second guide wheels are mounted, respectively, in a generally vertical disposition at the free ends of said first and second divert arms, and said first and second divert wheels are mounted, respectively, on said first and second divert arms in a generally horizontal disposition, such that when one of said guide wheels engages said ramp means, the one divert arm on which said one guide wheel is mounted is caused to pivot so as to bring said one divert wheel into engagement with an outboard surface of said generally vertical wall portion of one of said rails, whereby said car is locked onto said one rail by said one divert wheel and one of said second travel wheels.

8. Direction control assembly for a material handling car having travel wheels mounted thereon and adapted to operate on a track having parallel opposed u-shaped rails, the control assembly comprising:

a ramp assembly including a first ramp disposed adjacent and outboard of a first of said rails and a second ramp disposed adjacent and outboard of a second of said rails, said ramp assembly being disposed upstream of a bifurcation of said track into first and second tracks, said ramp assembly being adapted to receive and respond to a computer signal to direct a next approaching car onto one of said first and second tracks, detection means upstream of said ramp assembly to detect the approach of said car and to instruct a computer to identify said car and to instruct said computer to signal said ramp assembly to move one of said first and second ramps to a position at which said one ramp will be engaged by arm means extending from said car, and rail engagement means disposed on said car and operable by said arm means, upon engagement with said ramp assembly, to engage one of said first and second rails and thereby attach said car to said one rail, whereby said car moves along said one rail onto said one of said first and second tracks, said arm means comprising a first arm extending from a first side of said car and engageable with said first ramp when said first ramp is engageably positioned, and a second arm extending from a second side of said car and engageable with said second ramp when said second ramp is engageably positioned, said rail engagement means comprising first rail engagement means fixed to said first arm on said first side of said car and adapted to engage said first of said rails when said first arm engages said first ramp, and a second rail engagement means fixed to said second arm on said second side of said car and adapted to engage said second of said rails when said second arm engages said second ramp, each of said first and second arms comprising a divert arm pivotally mounted on said car and having mounted thereon a guide wheel for said engagement with said ramp, each of said first and second rail engagement means comprising a divert wheel mounted on said divert arm, respectively, said travel wheels including two wheel assemblies on each of said sides of said car, each wheel assembly including a first generally vertical travel wheel engaged with a bottom plate portion of said rails, and a second generally horizontal travel wheel adapted to engage a generally vertical wall portion of said rails, wherein on each one of said divert arms one of said guide wheels is mounted in a generally vertical disposition at the free end of said one divert arm, and one of said divert wheels is mounted on said one divert arm in a generally horizontal disposition, such that when said one guide wheel engages one of said ramps, said one divert arm is caused to pivot so as to bring said one divert wheel into engagement with an outboard surface of said generally vertical wall portion of one of said rails, whereby said car is locked onto said one rail by said one divert wheel and one of said second travel wheels, and divert modules attached to said track and having therein channel means adapted to receive said one guide wheel from said one ramp and retain said one guide wheel in position to retain said one divert wheel in said rail-engaging position until said car moves onto said one of said first and second tracks.

9. The control assembly in accordance with claim 8 wherein each of said ramps is adapted to be engaged by one of said guide wheels on an undersurface of said ramp, said ramps being configured to force said guide wheels downwardly, to pivot downwardly said divert arm on which said one guide wheel is mounted, to move said divert wheel mounted on said divert arm downwardly into said engagement with said outboard surface of said generally vertical wall portion of said one rail.

10. Direction control assembly for a material handling car adapted to operate on parallel rails, the control assembly comprising a first ramp disposed adjacent and outboard of a first of the rails and a second ramp disposed adjacent and outboard of a second of the rails, the ramps being disposed upstream of a bifurcation of the rails, the ramps being adapted to receive and respond to signals to direct a next approaching car into a selected rail path, detection means upstream of the ramps to detect approach of the car and to initiate said signals to the ramps, guide wheels mounted on divert arms pivotally mounted on both sides of the car, a divert wheel mounted on each of said divert arms, the ramps being adapted in response to said signal to assume a position in which one of said ramps is engaged by one of said guide wheels to cause one of said divert wheels to lock onto one of said rails, and divert modules attached to said rails and having therein channel means adapted to receive said guide wheels from said ramps and retain said guide wheels in position to retain said one of said divert wheels in said rail engaging position, whereby to lock the car to a selected rail such that the car follows the selected rail into said selected rail path.

11. Direction control assembly for a material handling car having travel wheels mounted thereon and adapted to operate on parallel rails, said rails each comprising a horizontal plate portion on which said travel wheels are adapted to roll, and a vertical plate portion adapted to contain said wheels on said rail horizontal plate portion, said control assembly comprising a ramp assembly including a first ramp disposed adjacent and outboard of a first of said rails and a second ramp disposed adjacent and outboard of a second of said rails and generally abreast of said first ramp, said ramps being disposed adjacent the path of travel of the car upstream of a bifurcation of the rails into a main track and a side track, said ramp assembly being adapted to receive and respond to signals from a computer to direct a next approaching car onto one of said main track and said side track, detection means upstream of said ramp assembly operative to detect the approach of said car and initiate said signals from said computer to said ramp assembly, a first guide wheel mounted on a first arm extending outwardly from said car on a first side of said car, a second guide wheel mounted on a second arm extending outwardly from said car on a second side of said car, each of said guide wheels being connected to a divert arm pivotally mounted on the car and having mounted thereon a divert wheel rotatable about a generally vertical axis, said ramps being adapted in response to said signal and said instructions to move to a position in which one of said ramps is engageable by one of said guide wheels, causing one of said divert arms to pivot and one of said divert wheels to engage said vertical plate portion of a selected one of said first and second rails, and divert modules attached to said rails and having therein channel means adapted to receive said guide wheels from said ramps and retain said guide wheels in position to retain said one of said divert wheels in said rail engaging position, whereby to connect said car to said selected rail such that said car follows said selected rail into the selected one of said main track and said side track.

12. The direction control assembly in accordance with claim 11 and further including in said ramp assembly an interlock mechanism interconnecting said first ramp and said second ramp and adapted to permit only one of said first and second ramps to be moved to an activating position for a given car.

13. A ramp assembly for use in a material handling car and track system in which the car travels along parallel tracks, the ramp assembly being adapted to cooperate with guidance structure on the car to lead the car in a selected one of a pair of paths in a bifurcation of the track, said ramp assembly comprising a frame in part extending widthwise beneath said tracks, moving means mounted on said frame, an axle extending widthwise of said tracks and adapted to be rotatably driven by said moving means, a plate fixed to each end of said axle and rotatable therewith, a drive rod eccentrically and pivotally mounted at one end to each of said plates, each of said drive rods being pivotally connected at a second end thereof to a ramp member, each ramp member being pivotally mounted on an upstanding portion of said frame, said drive rods being mounted on said plates such that when a first of said drive rods is raised by rotation of its plate, a second of said drive rods is lowered by corresponding rotation of its plate, whereby when said moving means operates to rotate said axle and thereby, said plates, only a selected one of said ramp members is raisable at a given time to engage appropriate portions of said guidance structure on said car to lead said car in said selected path.

* * * * *

UNITED STATES PATENT AND TRADEMARK OFFICE

CERTIFICATE OF CORRECTION

PATENT NO. : 5,277,124
DATED : January 11, 1994
INVENTOR(S) : DiFonso et al.

It is certified that error appears in the above-indentified patent and that said Letters Patent is hereby corrected as shown below:

Column 5, line 11, after "passes" insert --second detection means, such as --

Signed and Sealed this

Twenty-first Day of June, 1994

*Attest:*

Bruce Lehman

BRUCE LEHMAN

*Attesting Officer*

*Commissioner of Patents and Trademarks*